United States Patent [19]

Rullier

[11] Patent Number: 4,928,990

[45] Date of Patent: May 29, 1990

[54] FREELY SLIDABLE ANTIFRICTION PLATE WHICH AUTOMATICALLY RECENTERS FOR SAFETY BINDING

[75] Inventor: Pierre Rullier, Annecy, France

[73] Assignee: Salomon S.A., Annecy Cedex, France

[21] Appl. No.: 149,665

[22] Filed: Jan. 28, 1988

[30] Foreign Application Priority Data

Jan. 28, 1987 [FR] France ..... 87 01287

[51] Int. Cl.[5] ..... A63C 9/081; A63C 9/085

[52] U.S. Cl. ..... 280/625; 280/629; 280/634; 280/636

[58] Field of Search ..... 280/618, 620, 625, 626, 280/629, 630, 634, 636

[56] References Cited

U.S. PATENT DOCUMENTS

| | | | |
|---|---|---|---|
| 3,037,785 | 6/1962 | De Place | 280/629 |
| 3,950,002 | 4/1976 | Schweizer et al. | 280/625 |
| 4,088,343 | 5/1978 | Krob | 280/625 |
| 4,277,083 | 7/1981 | Himmetsberger et al. | 280/618 |
| 4,398,747 | 8/1983 | Bernard et al. | 280/630 |
| 4,449,730 | 5/1984 | Oberleitner et al. | 280/634 X |
| 4,484,764 | 11/1984 | Kipsch | 280/628 |
| 4,516,792 | 5/1985 | Scheck et al. | 280/634 X |
| 4,679,815 | 7/1987 | Pascal et al. | 280/620 X |

FOREIGN PATENT DOCUMENTS

| | | | |
|---|---|---|---|
| 0031740 | 7/1981 | European Pat. Off. . | |
| 2092844 | 1/1972 | France . | |
| 2334383 | 7/1977 | France . | |
| 490871 | 7/1970 | Switzerland . | |
| 568770 | 11/1975 | Switzerland | 280/625 |
| WO85/03451 | 8/1985 | World Int. Prop. O. . | |

*Primary Examiner*—Charles A. Marmor
*Assistant Examiner*—Brian L. Johnson
*Attorney, Agent, or Firm*—Sandler, Greenblum & Bernstein

[57] ABSTRACT

A safety binding for binding a boot to a ski, which includes first and second laterally pivotable independent wings adapted to retain one end of the boot on the ski. Each of the wings is mounted to pivot around respective first and second lateral pivot axes. Elastic return means bias each of the wings towards a centered stable maintenance position of the boot. The apparatus includes a movable antifriction plate adapted to slide laterally in a sliding zone of the upper surface of the ski. An intermediate linkage assembly is provided for associating the antifriction plate with the binding wings. The intermediate linkage assembly is adapted whereby lateral pivoting of either of the wings permits rearward movement of the linkage assembly whereas return of either of the wings to the centered position assures the return of the intermediate linkage assembly towards its front longitudinal extreme position. The intermediate linkage assembly is linked with the antifriction plate in a manner so as to permit free lateral movement of the antifriction plate between two extreme positions. The spacing between the extreme positions of the antifriction plate is proporational to the extent of displacement of the intermediate linkage assembly, and return of the intermediate linkage assembly towards its front longitudinal extreme position tends to recenter the antifriction plate.

25 Claims, 5 Drawing Sheets

FREELY SLIDABLE ANTIFRICTION PLATE WHICH AUTOMATICALLY RECENTERS FOR SAFETY BINDING

FIELD OF THE INVENTION

The present invention relates to safety bindings for skis adapted to maintain, in a laterally releasable fashion, one of the ends of a boot with respect to a ski. The binding according to the invention can retain either the front of the boot, or the rear, but it is, however, more particularly adapted to retain the front.

DESCRIPTION OF BACKGROUND AND RELEVANT INFORMATION

Such a binding assures the safety of a skier by responding, through its lateral release, to excessive torsional forces at the level of the leg of the skier. The conventional types of safety bindings, of the lateral release type, have a certain number of disadvantages, particularly when a torsional fall is combined with a frontward fall. In effect, during a frontward shift of the weight of the skier, the bottom of the sole of the boot which is at the level of the front of the foot is applied against the ski with a substantial force directed thereto, i.e., downwardly, which serves to create, between the bottom of the sole and the support surface thereof, a substantial frictional force which opposes the lateral displacement of the boot.

A solution has long been sought to the problem of these safety bindings of the lateral release type, to provide a safety binding which maintains the boot without moving during normal skiing, i.e., a stable maintenance position of the boot, substantially in the longitudinal, vertical median plane of the binding, and which is laterally releasable in a sure fashion by reducing to the maximum the frictions between the sole of the boot and the upper surface of the ski.

It has thus been proposed to glue to the surface of the ski a plate made of an anti-stick material, such as described in French Patent No. 2 092 844, but the cleats or treads which may be provided under the sole of the boot considerably increase the friction, and dirt may render it beyond control.

To further diminish friction, it has been proposed to insert between the sole of the boot and the upper surface of the ski a movable support plate adapted to be laterally displaced with the boot. The sliding between the movable plate and the ski is in this case not disturbed by dirt or the cleats of the boot.

A first solution, described in WO85/03451, has involved utilizing a plate affixed to the binding. However, in this first case, if ice forms between the plate and the ski there is a blockage of the binding or at least a very substantial disturbance of its operation.

A second solution, described in Swiss Patent No. 490,871, has consisted in providing a rotatable plate, positioned on the upper surface of the ski, and returned to the central position by a recentering spring. The disadvantage is that during release of the binding the boot makes the plate pivot against the energy of its recentering spring. This energy is added to the energy of the binding and increases the force which the leg must overcome to obtain the release of the binding.

SUMMARY OF THE INVENTION

The present invention has in particular as an object to provide a safety binding having an automatically recentering antifriction plate in which the recentering means of the antifriction plate do not disturb the release of the binding and the movement of the boot, and in which the braking or the possible blockage of the antifriction plate by ice does not prevent the release of the binding.

According to another object of the invention, the return of the antifriction plate is assured by the binding itself, such that it does not require any supplemental return means.

The solution according to the present invention preferably applies to bindings comprising a fixed body provided with first and second laterally movable and independent wings, adapted to laterally retain one end of the boot, the wings being pivotably mounted around vertical or approximately vertical shafts which are laterally offset from the fixed body and which are biased by elastic return means towards a stable maintenance position of the boot in the vertical, longitudinal median plane of the binding. The bindings having independent wings are bindings in which the wings are displaced in an approximately symmetrical fashion with respect to the plane of symmetry of the ski, or in which one wing displaces itself without moving the other. In other terms, a spacing movement of one wing with respect to the longitudinal plane of symmetry of the ski causes on the other wing a spacing bias which is either null or opposed with respect to the plane of symmetry.

The wing binding having independent wings generally comprises two lateral arms separated by a central journal zone around the corresponding vertical shaft. A first lateral arm is laterally oriented towards the exterior and towards the rear of the binding to form the jaw which assures the retention of the sole of the ski boot. A second lateral arm is laterally oriented towards the interior of the binding, and thus moves towards the vertical longitudinal median plane of the binding. The second arm cooperates with a movable central abutment, having longitudinal displacement, biased toward the front by elastic return means. In its frontward return movement, the movable abutment biases towards the front the second lateral arms of the independent wings, and thus assures the return of the wings to the centered stable maintenance position of the binding, or rest position.

It is observed that, during release or return movements of the binding, i.e., during pivoting movements of the independent wings, the lateral arms of the wings and the movable abutment are moved in movements which have a longitudinal component, or component parallel to the longitudinal median axis of the binding. The invention takes advantage of this observation to provide mechanical linkage means between the wings of the binding and the antifriction plate.

To achieve these objects as well as others, on a safety binding having independent wings of the type mentioned above, the antifriction plate is guided by vertical and longitudinal guidance means allowing for a free lateral movement. The antifriction plate is mechanically connected to the binding wings by an intermediate linkage assembly mounted slidably longitudinally between a first extreme fixed longitudinal position and a second extreme variable longitudinal position. The assembly of the intermediate linkage is mechanically connected to the wings in a manner such that when one lateral wing is pivoted with respect to its centered, stable maintenance position, the second extreme, longitudinal position of the assembly of the intermediate linkage is an increasing function of the pivoting of the biased wing, and the return of the wings to the centered position assures the return of the assembly of the intermediate linkage towards its first extreme longitudinal position. The intermediate linkage assembly is mechanically connected to the antifriction plate to control the free lateral movement of the plate between two extreme states, such that the extreme states that the antifriction plate has with respect to the vertical longitudinal median plane of the binding provides a spacing which is an increasing function of the displacement of the intermediate linkage assembly towards its second extreme longitudinal position, and that the return of the assembly of the intermediate linkage towards its first longitudinal extreme position tends to recenter the antifriction plate. In this way, the opening of the wings towards the exterior frees the antifriction plate without moving it, and the return of the wings towards the interior tends to recenter the antifriction plate. The opening of the wings towards the exterior frees the antifriction plate without moving it, such that if the antifriction plate is blocked or braked by the ice, the binding itself is not braked, and can pivot towards its release position. The boot can laterally displace the antifriction plate without having to overcome the force of the supplemental elastic return means of the antifriction plate. The return of the wings towards their stable maintenance position of the boot tends to recenter the antifriction plate and to progressively limit its movement. In the centered, stable maintenance position of the binding, the intermediate linkage assembly preferably maintains the antifriction plate with a small play in a centered position, i.e., with no or little play.

Preferably, the intermediate linkage assembly limits the lateral movement of the antifriction plate in all positions of the binding between the centered, stable maintenance position and the release positions. Thus, the intermediate linkage assembly permanently forms, whatever its position, an abutment preventing an excessive lateral escape of the antifriction plate.

According to a particularly simple and strong embodiment, the intermediate linkage assembly comprises a central slide whose front end is affixed to the mobile abutment of the binding. Its longitudinal position is thus permanently defined by the pivoting of the wings.

According to another embodiment, the intermediate linkage assembly comprises an independent central slide comprising a front portion of which one rear surface faces one front surface of the mobile binding abutment. In this way, in the centered, stable maintenance position of the wings, the front surface of the mobile abutment rests against the rear surface of the front portion of the slide to maintain the slide against a fixed abutment in its first longitudinal, extreme position. In the pivoted position of at least one wing, the mobile abutment is longitudinally displaced and the slide allows for a free longitudinal movement between its first longitudinal, extreme, fixed position and a second extreme, longitudinal position in which the rear surface of the front portion of the slide rests against the front surface of the mobile abutment. In this embodiment, if the antifriction plate or the intermediate linkage assembly is blocked by ice, the binding itself is not braked, and can pivot normally towards its release position.

According to one embodiment, the slide comprises a rear projecting portion inserted in a larger opening of the antifriction plate, the opening of the antifriction plate being limited by two centering ramps oriented angularly on both sides of the longitudinal axis of symmetry of the plate to form a dihedral opening towards the rear and having a front central apex. In the first longitudinal, extreme position of the slide, the projecting portion is lodged in the apex of the dihedral, resting simultaneously on the two centering ramps, to center the antifriction plate.

According to another embodiment, the slide comprises first and second projecting rear portions laterally offset on both sides of the median axis and respectively inserted in first and second lateral, symmetrical openings of larger dimension of the antifriction plate. The openings are each limited by an interior centering ramp angularly oriented towards the rear, the maximum spacing of the ramps corresponding to the spacing of the projecting portions to assure the centering of the antifriction plate in the centered, stable maintenance position of the wings.

According to another similar embodiment, the antifriction plate comprises a projecting portion inserted in an opening of larger dimension of the slide, the opening being limited by two centering ramps angularly oriented on both sides of the median axis to form a dihedral which opens towards the front and has a central, posterior apex.

According to another embodiment of the invention, the intermediate linkage assembly comprises two independent slides which are laterally offset on both sides of the median axis of the binding, with each comprising an anterior portion cooperating with one of the binding wings or with the mobile abutment, and a rear portion forming an abutment to limit the lateral extent of movement of the antifriction plate.

BRIEF DESCRIPTION OF DRAWINGS

Other objects, characteristics and advantages of the present invention will become clear from the following description of particular embodiments, given with reference to the annexed drawings, in which:

FIGS. 12 and 13 illustrate, respectively, in side and top view a front safety binding having independent wings, according to one generally known embodiment, to which has been adapted the means according to the invention for the linkage between the wings and an antifriction plate.

DESCRIPTION OF PREFERRED EMBODIMENTS

Figure 13:
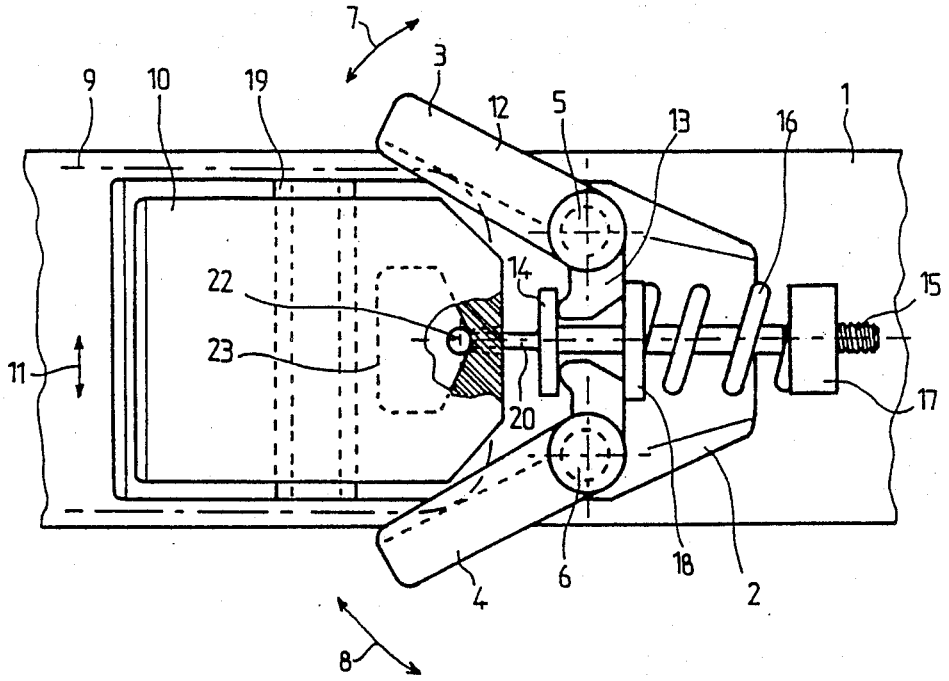

As shown in the figures, the binding is adapted for use on the upper surface of a ski 1 on a fixed base 2 (FIG. 13). The binding comprises a first lateral wing 3 and a second lateral wing 4, pivotably mounted respectively around a first vertical fixed shaft 5 and a second vertical fixed shaft 6, as are shown by double arrows 7 and 8. Wings 3 and 4 are shaped to maintain the front end of a boot schematically shown by dashed lines 9. The sole of the boot rests on antifriction plate 10 which is adapted to allow for lateral movement, as shown by double arrow 11.

Wings 3 and 4 comprise two lateral arms separated by a central journal zone around a corresponding vertical shaft. Thus, the first wing 3 comprises a first lateral arm 12 which is laterally oriented towards the exterior and towards the rear of the binding to form one-half of the jaw, assuring the retention of the sole of boot 9. Wing 3 comprises a second lateral arm 13, oriented laterally towards the interior of the binding and thus approaching the median longitudinal, vertical plane I-I of the binding. The second arm 13 cooperates with a movable, central abutment 14, having longitudinal displacement along plane I-I of the binding, the abutment 14 being affixed to a longitudinal tension element 15 which is biased towards the front by compression spring 16, which is itself inserted between an adjustable nut 17 on a threaded portion of the tension element and a fixed abutment 18 of the binding. The fixed abutment 18 and the shafts 5 and 6 are affixed to base 2 of the binding.

Figure 12:
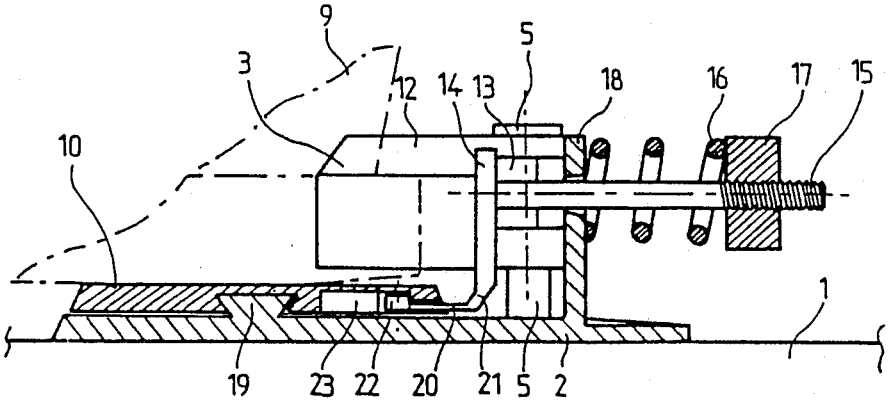
FIGS. 12 and 13 illustrate in a more detailed fashion a binding according to the invention in the embodiment of FIGS. 1 and 2.

In the embodiment shown in FIG. 12, antifriction plate 10 is slidably mounted on transverse guides 19 of base 2, for example, shown as dovetail guides.

Figure 10:
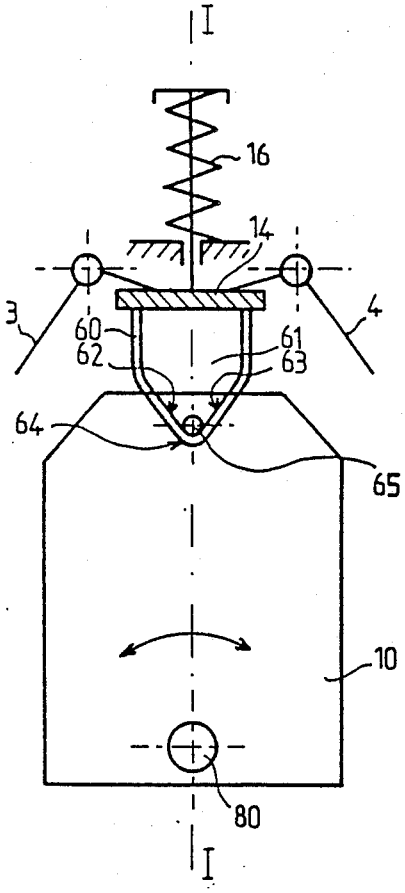
FIG. 10 illustrates another embodiment having a single, central slide and pivotable antifriction plate.

However, the present invention is likewise applicable to antifriction plates which are pivotably mounted around a rear vertical shaft 80, as shown for example in FIG. 10, in a particular embodiment.

In the embodiment shown in FIGS. 12 and 13, the mobile abutment 14 is affixed to a central slide member 20, extending toward the rear of the binding as shown in the figures, whose front end 21 is affixed to the mobile abutment 14, and whose rear abutment 22 forms a projecting portion inserted in an opening 23 of the antifriction plate 10. The opening 23 has a particular shape having lateral centering ramps, as is explained below.

Figure 1:
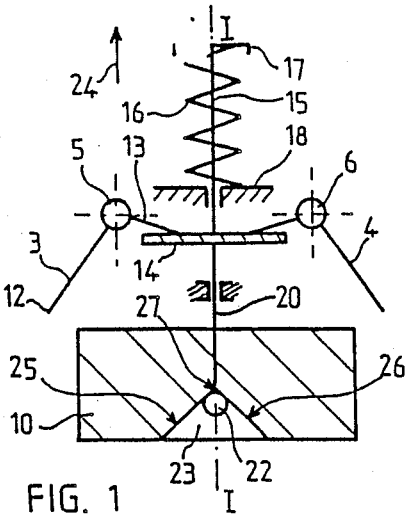
FIGS. 1 and 2 schematically illustrate the constitution and operation of a binding according to the invention in a first embodiment having a central slide affixed to the movable abutment.
Figure 2:
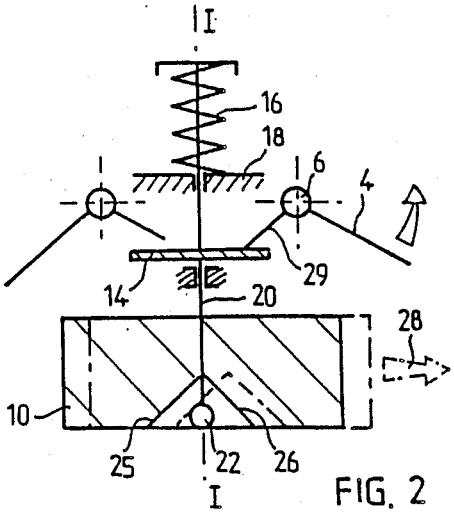

With references to FIGS. 1 and 2, these figures illustrate in a schematic manner the constitution and operation of a binding according to the embodiment of FIGS. 12 and 13. In these FIGS. 1 and 2, homologous elements to those shown in FIGS. 12 and 13 are identified by the same reference numerals.

In FIG. 1, the binding is shown in the centered, stable maintenance position of the boot. In this position, the central mobile abutment 14 is advanced to the maximum, towards the front of the binding, i.e., in the direction shown by arrow 24, and its position is determined by a fixed abutment, not shown. Wings 3 and 4 laterally maintain the boot, and the rear ends of the second arms such as arm 13 rest against the front surface of mobile abutment 14. Slide element 20 is thus in a first extreme longitudinal position, or front extreme position.

The rear end of slide 20, or projecting portion 22, is inserted in opening 23 of the antifriction plate 10. The opening 23 has larger dimensions than the projecting portion 22, and is defined by two lateral centering ramps 25 and 26 which are angularly oriented on both sides of the longitudinal plane of symmetry of antifriction plate 10 to form a dihedral which opens toward the rear and which has a central front apex 27, as shown in the Figure. In the centered, stable maintenance position of the binding, the projecting portion 22 of slide 20 is lodged in apex 27 of opening 23, being simultaneously carried against the lateral ramps 25 and 26 to maintain the antifriction plate 10 with little or no play, preventing lateral displacement.

During normal use, the boot is maintained in the centered equilibrium position as shown in FIG. 1. As a result of substantial bias, the boot laterally pushes one of the wings, for example, wing 4 as shown in FIG. 2, which tends to bring the binding into a release position in which the end of the boot is free and can laterally escape in the direction shown by arrow 28. During rotation of wing 4, its second arm 29 pushes the mobile abutment 14 towards the rear of the binding, against the bias of return spring 16. In its retreating movement, the mobile abutment 14 causes slide 20 to move. In the release position, slide 20 reaches a second extreme longitudinal position, shown in the figure, in which the projecting portion 22 is in the wide portion of opening 23. It is understood that, in this position, the antifriction plate allows for a free transverse movement between the two end states in which one of ramps 25 or 26 is carried against the projecting portion 22 of slide 20. In particular, antifriction plate 10 can accompany the movement of the boot in the direction of arrow 28.

When the release bias stops, spring 16 returns wings 3 and 4 towards their centered maintenance position, and returns the mobile abutment 14 and slide 20 towards the front in the position of FIG. 1. The projecting portion 22, cooperating with ramp 25 or ramp 26, returns the antifriction plate 10 to the centered position shown in FIG. 1.

It is understood that the pivoting of wing 4 towards the release position of FIG. 2 does not cause the displacement of the antifriction plate 10. However, only the pivoting of the wing allows for the lateral displacement of the antifriction plate 10. Thus, if the antifriction plate 10 is blocked or braked by ice which has formed between its lower surface and the upper surface of the ski, the pivoting of wing 4 is not disturbed by the presence of this ice. The upper surface of the antifriction plate 10 thus functions as a conventional antifriction surface on which the boot slides.

In the absence of ice between the antifriction plate and the ski, the boot translationally moves the antifriction plate 10 at the same time as wing 4. The pivoting of the antifriction plate does not require, on the part of the boot, any additional bias, because the antifriction plate is free to move transversely, its displacement being limited only by the projecting portion 22 of slide 20. No energy in the area of the plate disturbs the release of the binding.

Figure 3:
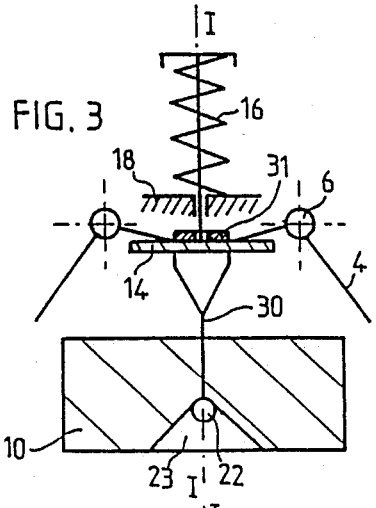
FIGS. 3–5 schematically illustrate the constitution and operation of a binding according to the invention in a second embodiment having a single, central independent slide.
Figure 4:
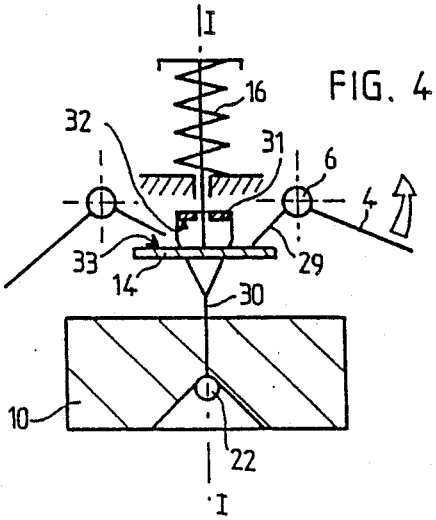
Figure 5:
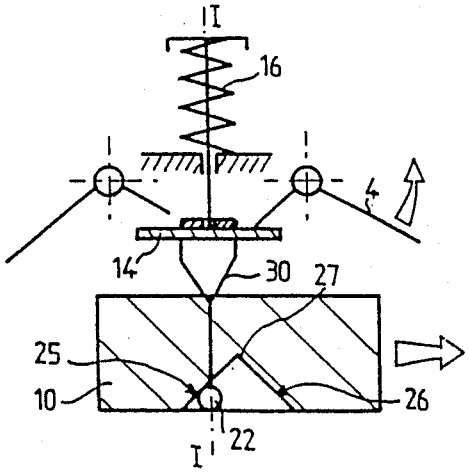

In the embodiment shown in FIGS. 3–5, the mechanical linkage between the mobile abutment 14 and the antifriction plate 10 is assured by a central, independent slide 30 having longitudinal sliding. In the embodiment shown, the central slide 30 is mechanically connected to the antifriction plate 10 in the same way as in the embodiment shown in FIGS. 1 and 2. A projecting portion 22 is positioned in an opening 23, as previously described. On the other hand, in this embodiment, slide 30 comprises a front portion 31 whose rear surface 32 faces a front surface 33 of movable abutment 14. The length of slide 30 is selected such that, in the stable, centered maintenance position shown in FIG. 3, the projecting portion 22 of slide 30 is positioned in apex 27 of opening 23 of antifriction plate 10, and rear surface 32 of front portion 31 of slide 30 rests against the front surface 33 of movable abutment 14.

Figure 5A:
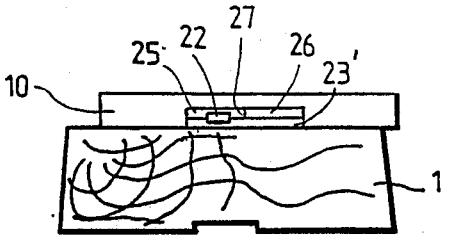
FIG. 5*a* illustrates an elevation view of the second embodiment of the invention.

In the pivoted position of at least one wing, as shown in FIG. 4, the movable abutment 14 is longitudinally displaced, towards the rear in the embodiment shown, and slide 30 can thus slide in free longitudinal movement between its front end position, shown in FIG. 3, and a rear end position, shown in FIG. 5, i.e., a rear extreme position in which the rear surface 32 rests against the front surface 33 of mobile abutment 14. In this latter position shown in FIG. 5, the antifriction plate 10 can slide freely between two extreme states in which ramps 25 or 26 come to rest against projecting portion 22, FIG. 5*a* schematically illustrates this embodiment of the invention in elevation as viewed from the rear. As shown therein, communicating with the opening 23, within which the projecting portion 22 of the slide member 30 is positioned, is an opening 23' which receives the slide member 30, to which the projecting portion 22 is affixed, to permit the antifriction plate 10 to slide laterally thereover when the antifriction plate is freed to slide laterally. FIG. 5*a* is schematic and has thus omitted therefrom other elements of the binding like those illustrated in FIG. 12, for example, including the fixed base 2.

Thus, in this embodiment, the pivoting of at least one wing frees slide 30 and antifriction plate 10, along a limited movement which is an increasing function of the pivoting of the wing. Under the action of a force applied by the boot, antifriction plate 10 can laterally slide towards the right or left, causing the longitudinal retracting movement of the slide as a result of the effect of ramps 25 or 26 on projecting portion 22, until reaching the extreme rear position of the slide. During the return of the wing towards the centered equilibrium position, spring 16 simultaneously assures the return of slide 30 and of antifriction plate 10 to the centered position shown in FIG. 3.

Figure 6:
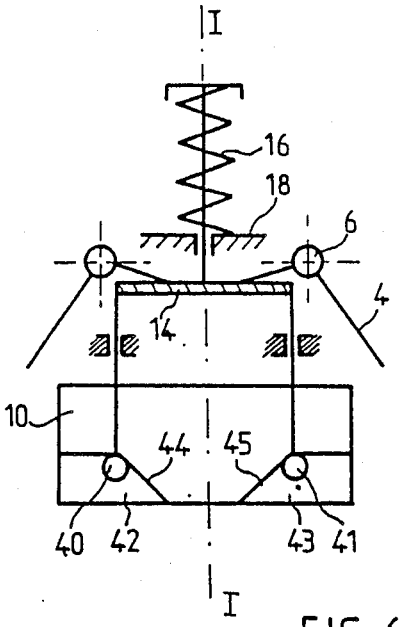
FIGS. 6 and 7 illustrate another embodiment having a double slide.
Figure 7:
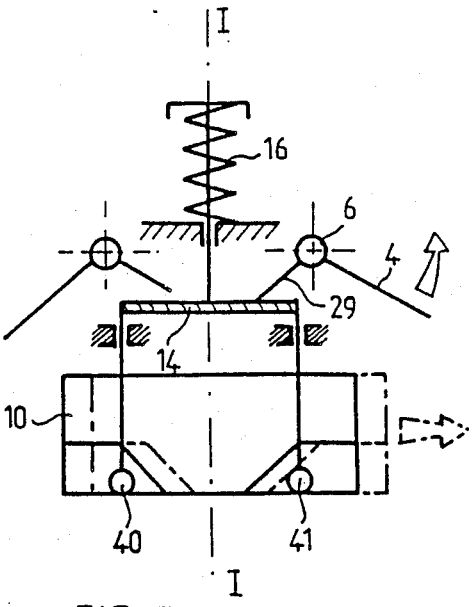

In the embodiment shown in FIGS. 6 and 7, the linkage between mobile abutment 14 and antifriction plate 10 is likewise performed by a slide affixed to abutment 14. In this embodiment, the slide comprises a first rear projecting portion 40 and a second rear projecting portion 41, respectively inserted in a first lateral opening 42 and a second lateral opening 43 of antifriction plate 10, the openings being of larger dimensions than the corresponding projecting portions, and being defined by an interior centering, ramp 44 and 45, respectively, angularly oriented toward the rear of the binding. The spacing of the ramps is selected such that, in their furthest spaced position, the ramps are spaced by a distance substantially equal to the spacing of projecting portions 40 and 41. In the stable centered maintenance position of the binding, shown in FIG. 6, the projecting portions 40 and 41, respectively, rest on front ends of ramps 44 and 45, assuring centering of the antifriction plate in the stable maintenance position. In the pivoted position of at least one wing, such as shown in FIG. 7, the mobile abutment 14 and the projecting portions 40 and 41 of the slide are pushed towards the rear of the binding, freeing the antifriction plate 10 which can thus laterally slide towards the right or left until extreme positions in which ramps 44 or 45, respectively, come to rest on the projecting portion 40 or projecting portion 41.

Figure 8:
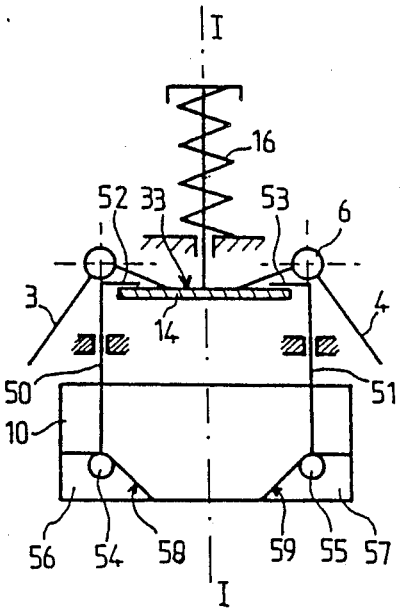
FIGS. 8 and 9 illustrate an embodiment according to the invention having two independent slides.
Figure 9:
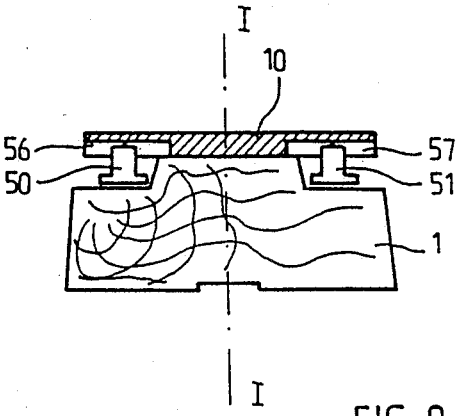

In the embodiment shown in FIGS. 8 and 9, the mechanical linkage between wings 3 and 4 of the binding and antifriction plate 10 is assured by an intermediate linkage assembly comprising two independent lateral slides 50 and 51, each mounted to slide longitudinally on both sides of the longitudinal plane I-I of the binding. Each slide comprises a front portion 52 and 53, respectively, being carried and abutted against the front surface 33 of mobile abutment 14. Each slide comprises a rear portion 54 and 55, respectively, forming a projection and penetrating into respective openings 56 and 57 of antifriction plate 10. Openings 56 and 57 are shaped in the same way as openings 42 and 43 of the embodiment of FIG. 6, and comprise lateral internal surfaces 58 and 59 which are carried against the projecting portions 54 and 55 of the slides. In the stable centered maintenance position of the binding shown in FIG. 8, ramps 58 and 59, respectively, bear against the projecting portions 54 and 55, assuring the centering of the antifriction plate 10. In the pivoted position of one of the wings, the mobile abutment 14 is retracted, freeing slides 52 and 53. Under the effect of a force exerted by the boot, the antifriction plate 10 can laterally slide towards the right or left, causing the longitudinal movement of one of the slides until the corresponding front portion 52 or 53 comes to abut against the mobile abutment 14. The return of the binding towards the stable centered maintenance position assures the return of slides 50 and 51 and of antifriction plate 10 to the centered position shown in FIG. 8. This embodiment can preferably be utilized with skis whose cross section comprises upper longitudinal cutaways, as shown in cross section in FIG. 9. In this case, slides 50 and 51 are positioned in the corresponding longitudinal openings of ski 1, as shown in the figure.

In all of the embodiments which have just been described, the slides comprise a projecting portion which is inserted in an opening or in openings of antifriction plate 10. One obtains similar results by reversing the position of the projecting portions and of the openings, i.e., by positioning the projecting portions on the antifriction plate and the openings in the slides.

By way of example, FIG. 10 illustrates on embodiment in which the slide 60 comprises an opening 61 having two lateral ramps 62 and 63 which form a dihedral which opens towards the front and having a central rear apex 64. Antifriction plate 10, which is rotatably movable around a fixed rear shaft 80, comprises a projecting portion 65 which is inserted in opening 61. In the stable centered binding maintenance position, projecting portion 65 is lodged in apex 64 of opening 61. In the release position of the binding, ramps 62 and 63 are retracted and spaced from spur 65 allowing for its movement towards the right or left, and thus allowing for the lateral displacement of the antifriction plate 10.

Figure 11:
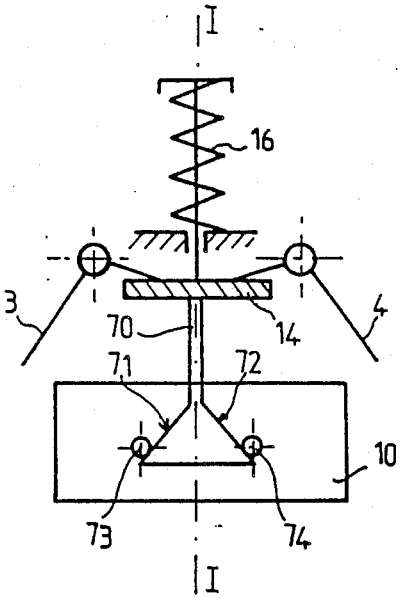
FIG. 11 illustrates another embodiment having a single, central slide.

Likewise, by way of example, FIG. 11 illustrates one embodiment in which slide 70, affixed to mobile abutment 14, comprises two rear ramps 71 and 72 which form a corner whose apex is oriented towards the front, the ramps being carried against two projecting portions 73 and 74 of antifriction plate 10. In the centered position, shown in the figure, the projecting portions 73 and 74, respectively, rest against ramps 71 and 72. In the release position of the binding, the slide 70 retracts and frees the projecting portions 73 and 74 and the antifriction plate 10 can thus oscillate towards the right or left.

Although the invention has been described with reference to particular means, materials and embodiments, it is to be understood that the invention is not limited to the particulars disclosed and extends to all equivalents within the scope of the claims. In particular, one can associate the different embodiments of the linkage between the antifriction plate 10 and the slides with the different embodiments of the linkage between the slides and the mobile abutment 14. Likewise, the slides can be associated not with mobile abutment 14, but directly with the first or second arms of wings 3 and 4.

I claim:

1. A safety binding for binding a boot to a ski, the ski having an upper surface, said binding comprising:

(a) first and second laterally pivotable independent wings adapted to retain one end of said boot on said ski, each of said wings being mounted to pivot around respective first and second lateral pivot axes;

(b) elastic return means for biasing each of said wings towards a centered stable maintenance position of the boot;

(c) a movable antifriction plate and means for permitting said antifriction plate to slide laterally in a sliding zone of the upper surface of said ski to and from a centered position; and (d) an intermediate linkage assembly connecting said antifriction plate with said wings, said intermediate linkage assembly comprising a slide member and a mobile abutment in contact with each other in said maintenance position of said boot, said mobile abutment being functionally associated with said wings and being biased by said elastic return means for biasing said wings towards said centered stable maintenance position of said boot, said mobile abutment and said slide member being arranged such that lateral pivoting of either of said wings causes movement of said mobile abutment from out of contact with said slide member, thereby permitting movement of said slide member away from a longitudinal extreme position independently of said mobile abutment to at least a predetermined extent, whereas return of either of said wings to said centered position is accompanied by return of said slide member towards said longitudinal extreme position, means for linking said slide member with said antifriction plate and for permitting lateral movement of said antifriction plate free from the effect of said elastic return means between two extreme positions in response to lateral pivoting of either of said wings, and whereby said extreme positions of said antifriction plate are spaced apart by a distance which is proportional to the extent of displacement of said slide member, and return of said slide member towards said longitudinal extreme position moves said antifriction plate towards said centered position.

2. The safety binding as defined by claim 1 further comprising a fixed base, wherein said antifriction plate is positioned adjacent to the fixed base to support the sole of the boot.

3. The safety binding as defined by claim 2 further comprising vertical and longitudinal means for guidance allowing for said free lateral sliding movement of said antifriction plate between said two extreme positions.

4. The safety binding as defined by claim 3 wherein said intermediate linkage assembly mechanically links said wings to said antifriction plate.

5. The safety binding as defined by claim 4 wherein said intermediate linkage assembly has an opposite longitudinal extreme position which is an increasing function of the extent of pivoting of either of said wings.

6. The safety binding as defined by claim 5 whereby opening of either of said wings allows for substantially free lateral sliding of said antifriction plate without moving it, and the return of either of said wings to their stable centered maintenance position is accompanied by recentering of the antifriction plate.

7. The safety binding as defined by claim 6 wherein said intermediate linkage assembly in the stable centered maintenance position of the binding maintains said antifriction plate with substantially no play in the stable centered position.

8. The safety binding as defined by claim 7 wherein said intermediate linkage assembly limits the lateral movement of the antifriction plate in all positions of the binding wings between the stable centered maintenance position and the release positions of the binding.

9. The safety binding as defined by claim 1 wherein said wings are elastically biased to their stable centered maintenance position by a longitudinally slidable mobile abutment frontwardly biased by a return spring, and wherein said intermediate linkage assembly comprises a slide member.

10. The safety binding as defined by claim 9 wherein said slide member is movable independently of said mobile abutment to at least a predetermined extent.

11. The safety binding as defined by claim 9 wherein said slide member comprises a rear projecting portion inserted in an opening of larger dimension in said antifriction plate.

12. The safety binding as defined by claim 11 wherein said opening is defined by two centering ramps angularly oriented on both sides of the longitudinal plane of symmetry of the antifriction plate to form a dihedral opening towards the rear and having a front central apex.

13. The safety binding as defined by claim 1 further comprising means for guiding said antifriction plate for lateral movement.

14. The safety binding as defined by claim 1 wherein, in said longitudinal extreme position, said intermediate linkage assembly is located in a frontwardmost position relative to said boot and, upon pivoting of either of said wings, said intermediate linkage assembly moves rearwardly with respect to said boot.

15. The safety binding as defined by claim 1 wherein said intermediate linkage assembly is linked with said antifriction plate in a manner so as to permit substantially free lateral movement of said antifriction plate only in response to lateral pivoting of either of said wings.

16. A safety binding for binding a boot to a ski, said ski having an upper surface, said binding comprising:

(a) first and second laterally pivotable independent wings adapted to retain one end of said boot on said ski, each of said wings being mounted to pivot around respective first and second lateral pivot axes;

(b) elastic return means for biasing each of said wings towards a centered stable maintenance position of the boot, said elastic return means comprising a longitudinally slidable mobile abutment frontwardly biased by a return spring;

(c) a movable antifriction plate and means for permitting said antifriction plate to slide laterally in a sliding zone of the upper surface of said ski to and from a centered position; and (d) an intermediate linkage assembly for associating said antifriction plate with said binding wings, said intermediate linkage assembly comprising a slide member movable independently of said mobile abutment and being arranged such that lateral pivoting of either of said wings permits movement of said linkage assembly away from a longitudinal extreme position, whereas return of either of said wings to said centered position is accompanied by return of said intermediate linkage assembly towards said longitudinal extreme position, said intermediate linkage assembly being linked with said antifriction plate in a manner so as to permit lateral movement of said antifriction plate free from the effect of said elastic return means between two extreme positions in response to lateral pivoting of either of said wings, and whereby said extreme positions of said antifriction plate are spaced apart by a distance which is proportional to the extent of displacement of said intermediate linkage assembly, and return of said intermediate linkage assembly towards said longitudinal extreme position moves said antifriction plate towards said centered position, wherein said intermediate linkage assembly comprises a front poriton whose rear surface faces the front surface of said mobile abutment, whereby in the stable centered maintenance position of the wings the front surface of the abutment rests against the rear surface of the front portion of the slide member to maintain the slide member in its first longitudinal extreme position, and wherein when at least one of said wings is outwardly pivoted said mobile abutment is longitudinally displaced and said slide member is allowed free longitudinal movement, caused by lateral movement of the antifriction plate, between first and second extreme longitudinal positions of said slide member.

17. The safety binding as defined by claim 16 in which the rear surface of said front portion abuts against the front surface of said mobile abutment when said slide member is in its second longitudinal extreme position.

18. A safety binding comprising:

(a) a first wing and a second wing for retaining one end of a boot on a ski, said wings being independently laterally pivotable about respective first and second axes;

(b) means for supporting said boot on said ski, said supporting means being slidable with respect to said ski to and from a centered position relative to said ski;

(c) means for biasing said wings towards a retention position for retaining said one end of said boot on said ski, and for biasing said supporting means toward said centered position;

(d) a linkage assembly comprising a longitudinally movable member and an abutment, said linkage assembly operatively associating said supporting means with said wings for permitting said supporting means to move laterally free from the effect of said biasing means in response to lateral pivoting of either of said wings, said abutment being movable independently of said longitudinally movable member, wherein respective portions of each of said wings contact said abutment, and wherein said biasing means act through said abutment for biasing said wings in said retention position; and (e) means for guiding said longitudinally movable member for movement between a first extreme position, in contact with said abutment, and a second extreme position, displaced from said abutment, wherein, in said first extreme position, said supporting means is in said centered position and wherein, in said second extreme position, said supporting means is permitted to slide laterally relative to said ski, and wherein upon pivoting of either of said wings, said longitudinally movable member is movable freed from the effect of said biasing means between said first and second extreme positions.

19. The safety binding of claim 18 wherein said biasing means includes an abutment against which respective portions of each of said wings contact and through which said biasing means acts to bias said wings in said retention position and wherein said linkage assembly comprises an element connected between said supporting means and said abutment, wherein upon pivoting of either of said wings, said element of said linkage assembly is substantially freely movable between said first and second extreme positions.

20. The safety binding of claim 18 wherein said biasing means includes an abutment against which respective portions of each of said wings contact and through which said biasing means acts to bias said wings in said retention position and wherein said linkage assembly comprises an element connected between said supporting means and said abutment to bias said supporting means toward said centered position, whereby upon pivoting of either of said wings, said element of said linkage assembly is freed from being biased by said biasing means for permitting said supporting means to move laterally.

21. The safety binding of claim 18 wherein said linkage assembly and said supporting means are configured and arranged such that said supporting means is permitted to move laterally only upon pivoting of either of said wings.

22. The safety binding of claim 18 wherein, when said portion of said linkage assembly moves to said second extreme position, said supporting means is permitted to move free from the effect of said biasing means.

23. The safety binding of claim 20 wherein said supporting means comprises an opening having centering surfaces and said linkage assembly includes a second abutment for engagement with said centering surfaces, wherein said biasing means biases said second abutment into engagement with said centering surfaces for maintaining said supporting means in said centered position.

24. The safety binding of claim 23 wherein said supporting means is movable laterally between opposite extreme positions in response to movement of said linkage assembly toward said second extreme position.

25. The safety binding of claim 24 wherein said opposite extreme positions of said supporting means are spaced apart by a distance determined by the distance by which said portion of said linkage assembly is moved toward said second extreme position.

* * * * *